US006145151A

United States Patent [19]

Herron et al.

[11] Patent Number: 6,145,151

[45] Date of Patent: Nov. 14, 2000

[54] ERGONOMIC BRUSH AND HANDLE THEREFOR

[76] Inventors: Harold F. Herron, 3425 Riverside Dr.; Jon T. Cox, 1094 Gasser Rd., both of Riverton, Wyo. 82501

[21] Appl. No.: 09/103,243

[22] Filed: Jun. 23, 1998

[51] Int. Cl.[7] ..... A46B 5/02

[52] U.S. Cl. ..... 15/143.1; 15/145; 15/257.05; 15/257.076; D4/138; 16/110 R; 16/114 R

[58] Field of Search ..... 15/143.1, 145, 15/160, 257.05, 257.076; 81/489; 16/110 R, 114 R; D4/138; D8/313, DIG. 7

[56] References Cited

U.S. PATENT DOCUMENTS

| | | |
|---|---|---|
| D. 167,775 | 9/1952 | Schmidt . |
| D. 240,678 | 7/1976 | Herig . |
| D. 309,379 | 7/1990 | Dawes . |
| 375,773 | 1/1888 | Rockwell . |
| 376,540 | 1/1888 | McQuide . |
| 412,479 | 10/1889 | Davis . |
| 1,888,930 | 11/1932 | McMillan . |
| 2,664,582 | 1/1954 | Kammann . |
| 2,914,785 | 12/1959 | Ela . |
| 3,023,439 | 3/1962 | Danley . |
| 4,454,623 | 6/1984 | O'Halloran . |
| 4,481,689 | 11/1984 | Westmoreland . |
| 4,490,875 | 1/1985 | Grunz . |
| 4,495,669 | 1/1985 | Nooper . |
| 4,751,762 | 6/1988 | Meimeteas . |
| 5,343,585 | 9/1994 | Howell . |
| 5,556,092 | 9/1996 | Theken . |
| 5,761,767 | 6/1998 | Barton . |

*Primary Examiner*—Gary K. Graham
*Assistant Examiner*—Jennifer McNeil
*Attorney, Agent, or Firm*—John E. Reilly

[57] ABSTRACT

A brush handle that provides an ergonomic grip to improve the manipulation and reduce the fatigue of the use of the brush. The brush handle provides a series of fitted control surfaces that allow a user to grip the brush handle in a comfortable and precise manner. These control surfaces are integrally formed on the brush handle on opposing surfaces for use by both right-handed and left-handed users. In one preferred embodiment, the brush handle is used for paint brushes. The brush handle also includes a protective mechanism to prevent paint from dripping or flowing onto the brush handle during use. The brush also provides a dip line to indicate the appropriate level of dipping the brush into a paint source.

31 Claims, 2 Drawing Sheets

ERGONOMIC BRUSH AND HANDLE THEREFOR

BACKGROUND OF THE INVENTION

This invention relates to handles; and more particularly to novel and improved handles and to paint brushes utilizing same.

Paint brushes have typically utilized elongated handles having flat side surfaces. Bristles or other application medium are attached to the elongated handle by a sheath or other attachment device. The paint brush is normally manipulated by the user grasping the elongated handle and/or by grasping the brush over the sheath. Pressure is applied against the handle in order to press the brush against the surface to which paint is to be applied. This manipulation of the brush is somewhat awkward due to the shape of the brush handle. This awkwardness translates into fatigue in the user's hand as well as blisters and callouses on the hand of the user. Additionally, this awkwardness inhibits the complete control of the manipulation of the brush.

Another problem with the prior brushes is the dripping of excess paint onto the brush handle itself. The brush is dipped into the paint prior to application. The brush is often dipped into the paint too far, thus causing paint to flow or drip onto the sheath and/or handle of the brush. Also, when the brush is used in an upwardly tilted movement, the paint has a tendency to flow or drip onto the sheath and/or handle of the brush. The wet paint creates a runny or tacky surface on the brush which causes discomfort to the user and reduces the life of the brush due to the inability of conventional brushes to adequately clean the bristles under and near the sheath.

A number of brush handles have been devised to solve these problems. For instance, U.S. Pat. No. 1,888,930, issued to McMillan discloses a paint brush having a handle positioned at an oblique angle to the head of the paint brush. This angular positioning of the handle enables the user to place the handle between the thumb and forefinger to minimize the rubbing of the handle against that surface, to prevent the brush from turning while being held and to allow the thumb to encircle the handle. However, this paint brush is held by using the thumb and by grasping the flat sheath by the forefinger which does not remedy the problems discussed above.

Other attempts to solve these problems are disclosed in U.S. Patent No. Des. 167,775, issued to Schmidt; U.S. Pat. No. 2,914,785, issued to Ela; and U.S. Pat. No. 4,495,669, issued to Hooper. These patents disclose paint brushes having various styles of "pistol grip" handles. These handles do not adequately solve the problems discussed above. Fatigue, awkwardness and dripping paint are still problems with these brushes.

Yet another problem with prior paint brushes or tools in general is the necessity of having a variety of different brushes or tools on hand when painting or working on other projects. Further, the brush handle is disposed of along with the brush when done. One prior attempt at solving this problem is disclosed in U.S. Pat. No. 5,343,585, issued to Howell. This paint brush assembly uses a tubular sleeve which slides over a clip member. The clip member can secure a replaceable brush head, scraper and shield.

It is therefore desirable to provide a handle, particularly for paint brushes, that will allow the handle to be comfortably yet firmly grasped to reduce fatigue and friction from use, that will enable the brush to be more easily and precisely manipulated, that will minimize dripping of paint onto the handle and that will extend the life of the brush. It is further desirable to provide a brush handle that will enable the brush to be grasped for fingertip use for fine brushwork and detail work and also to be grasped for full support by the user's hand for general purpose painting. It is yet further desirable to provide a brush assembly which allows a single brush handle to be used with various brush heads, tool heads or other accessories.

SUMMARY OF THE INVENTION

It is therefore an object of the present invention to provide for a novel and improved handle for implements, particularly for paint brushes. It is particularly an object of the present invention to provide a paint brush handle that will enable the user to reduce fatigue by the use of an ergonomically designed handle.

It is another object of the present invention to provide a novel and improved design of a handle that will enable a user to reduce the friction and pressure of the handle against the user's hand when in use.

It is another object of the present invention to provide a novel and improved design of a handle to allow the handle to be used in either hand.

It is another object of the present invention to provide a novel and improved design of a handle for ease and precision of manipulation.

It is another object of the present invention to provide a novel and improved design of a handle for minimizing dripping of paint onto the handle.

It is another object of the present invention to provide a novel and improved brush which minimizes over-dipping of the brush into the paint.

It is another object of the present invention to provide a novel and improved brush handle which extends the useful life of the brush It is another object of the present invention to provide a novel and improved brush having a better balance than previous paint brushes.

It is another object of the present invention to provide a novel and improved brush that can be incorporated as an integral brush or fitted over a portion of an existing brush.

It is another object of the invention to provide a brush assembly which allows a variety of brush heads, scrapers, accessories and other tools for use on a single handle.

In accordance with the present invention, a novel and improved handle is provided, particularly for use as a paint brush handle, that reduces the awkwardness of manipulating the brush as well as minimizing dripping of paint from the brush.

In one preferred embodiment of the brush of the present invention, a series of control surfaces are integrally formed on the brush handle. The control surfaces include upper surface control surfaces and lower surface control surfaces for engagement by the index finger and middle finger, respectively, of a user. Control surfaces are also formed on the opposing side surfaces of the brush handle for engagement by the thumb of a user. An additional control surface is formed on the reduced thickness of the distal end of the brush for engagement on the hand between the thumb and index finger of the user.

These control surfaces include generally elongated concave radii for comfortable and secure engagement by the user. The brush handle is thus contoured for an ergonomic fit by the user to minimize the awkwardness and fatigue of manipulation of the brush. The control surfaces include opposing control surfaces so that the brush handle is conformable for use by right-handed or left-handed users.

The brush handle also includes a protective mechanism on the bristle end of the brush handle. The protective mechanism, in the preferred embodiment, is an extended lip portion to protect from paint dripping from the bristles onto the brush handle. Additionally, a dip line is formed on a midportion of the bristles to indicate the appropriate level of dipping the brush into a paint source. This prevents "over dipping" to minimize paint dripping or flowing onto the brush handle, the user or the surrounding area.

In an alternative embodiment of the preferred embodiment, the brush handle is utilized in a brush assembly. The brush assembly includes a brush handle, as described above, which has a socket at its proximal end. This socket includes a recess for engaging a brush head. The brush head has a brush end and an engaging member. The engaging member is snugly received into the socket of the brush handle. This allows the brush head to be removed for disposal, to allow other types of brush heads or to allow other tool heads, such as scraper heads, or other accessories to be used with the same handle.

The above and other objects of the present invention will become more readily appreciated and understood from a consideration of the following detailed description of preferred and modified forms of the present invention when taken together with the accompanying drawings in which:

DETAILED DESCRIPTION OF A PREFERRED EMBODIMENT

Figure 1:
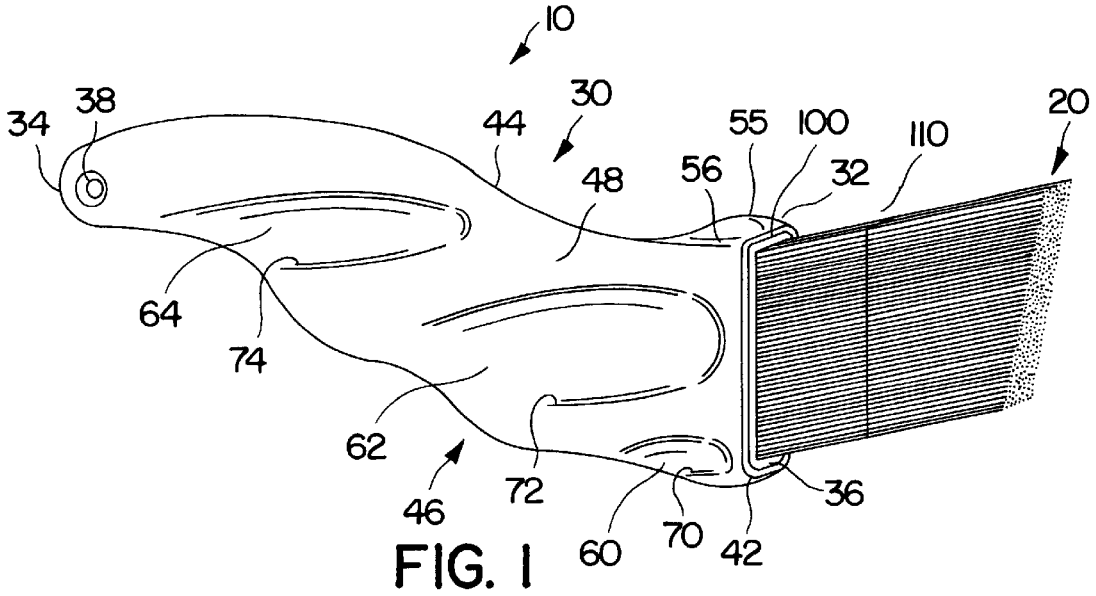
FIG. 1 is a perspective view of a preferred embodiment of the present invention illustrating a paint brush handle.

Referring in more detail to the drawings, as shown in FIGS. 1 through 4, a preferred embodiment of the present invention is described. In this particular preferred embodiment, a paintbrush 10 is illustrated. It is to be expressly understood that the present invention is intended for other types of brushes and that the paintbrush 10 is disclosed only for descriptive purposes. The paintbrush 10 includes a bristle portion 20 on one end of the paintbrush attached to a handle portion 30. While the bristle portion 20 is shown in the preferred embodiment and discussed below, it is to be expressly understood that other types of "application media" than bristles can be used as well, such as, sponge brushes, rollers or other types of application media. Also, while a "sash" or "trim" brush having an angled edge is shown as the preferred embodiment, the present invention is adapted for use with other types of brushes as well. The exemplary embodiment provided herein is intended for descriptive purposes only and is not meant to limit the scope of the inventive concept.

The paintbrush 10 includes a contoured handle portion 30. The contoured handle portion 30 includes a proximal end 32 and a distal end 34. A front portion 36 is formed on the proximal end 32 in which the bristle portion 20 is attached. This front portion 36 is in lieu of the sheath of the prior paint brushes. Front portion 36 includes an internal mechanism (not shown) for securing the bristles 20 to paintbrush 10. This internal mechanism can include any number of known devices, such as, a metal or plastic crimping band, adhesive bonding or other attaching devices. A lanyard hole 38 is formed on the distal end 34 of the contoured handle portion 30. The lanyard hole 38 is provided to hang the paintbrush to dry or for storage.

The front portion 36, in the descriptive preferred embodiment, is formed as an integral part of the contoured brush handle portion 30 and terminates in a front rounded edge 42. In the preferred embodiment of the present invention, the front portion 36 is formed as a seamless, integral part of the brush handle portion 30, as opposed to the prior paint brushes in which the sheath is a separate portion of the brush.

Figure 2:
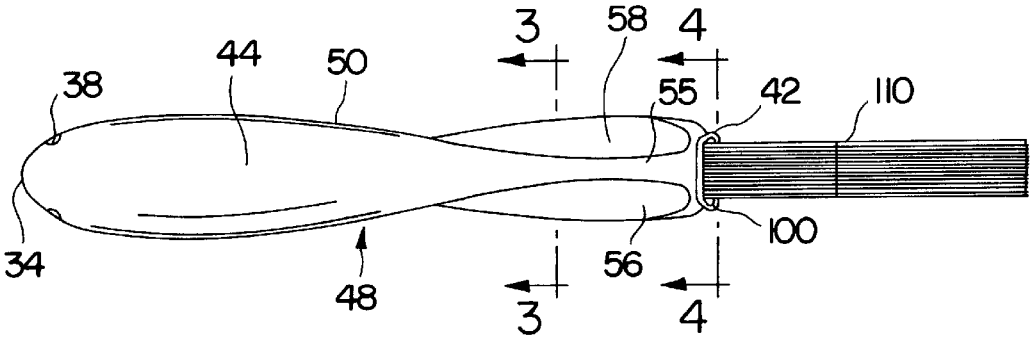
FIG. 2 is a top view of the embodiment of FIG. 1.
Figure 3:
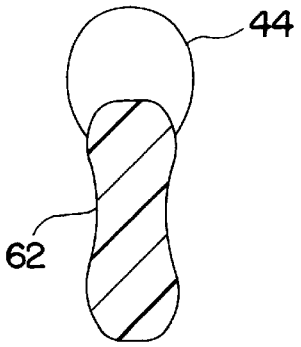
FIG. 3 is a cutaway view along lines 3—3 of FIG. 2.

The contoured handle portion 30 includes an upper surface 44 and a lower surface 46. The upper surface 44, as shown in FIG. 2, has a greater width near the distal end 34 and tapers down to a lesser width near the proximal end 32. Also, the upper surface 44 as well as the lower surface 46, as shown in FIG. 1, angle upwardly at acute angles from the front surface 42.

The upper surface 44, the lower surface 46 and the side surfaces 48, 50 (shown in FIG. 2) of the brush handle 30 form a gripping portion on the paint brush handle 30. Only side surface 48 is clearly illustrated in the accompanying Figures, but the opposing side surface 50 is identical in structure and function.

A plurality of control surfaces are formed in the gripping portion of the paint brush handle 30 to receive the fingers of the user. These control surfaces, as described in detail below, enable a user to comfortably grip and manipulate the paint brush in an ergonomic manner.

Upper control surfaces 56 and 58 are in the form of relatively shallow, generally concave indentations recessed in the upper surface 44 as well as extending partially rearwardly from the front edge 42; and the upper control surfaces 56 and 58 are separated by a common raised portion or ridge 55. The lower surface 46 includes a series of stepped surface portions 60, 62 and 64 which are stepped rearwardly and upwardly along the handle. The forward most surface portion 60 is provided with control surface portions in the form of indentations 70 symmetrically on either side of the handle.

Side control surfaces 72 and 74 are defined by concave indentations symmetrically on the side surfaces 48 and 50 of the brush handle 30. The concave indentation 72 and 74 extend in substantially lengthwise directions in closely spaced, parallel relation to one another and are staggered relative to one another and to the indentation 70. In the preferred embodiment, the concave indentation 70 and 72 are of substantially tear-dropped-shaped configuration, each tapering rearwardly away from a round or closed end. However, the upper concave indentation 74, if anything, diverges somewhat rearwardly into the rearward most stepped surface portion 64 directly beneath the distal end 34. The actual dimensions, ratios of dimensions and radii of the control surfaces are selected to best fit the average users hand and to provide a comfortable "feel" when the brush is used, although it will be evident that the specific shapes and dimensions of the control surfaces may be varied from those specifically described in the preferred embodiment.

In use, the gripping portion of the paintbrush 10 of the preferred embodiment has a number of improved features.

The paintbrush 10 is designed to be used in either the left hand or the right hand of the user without awkwardness. For example, a right-handed user would grasp the paintbrush 10 by placing the index finger of the right hand on the control surface 74 and onto the control surface 56. The thumb is placed on the control surface of the opposing side which is identical to control surface 72 shown in FIG. 1. The middle finger is placed under the control surface 70. The rear portion of the control surface 74 is placed over the top of the hand between the thumb and the index finger.

A left-handed user would use the opposing control surfaces. The index finger of the left hand is placed on the control surface of the opposing side as control surface 74 shown in FIG. 1 and onto the control surface 58. The thumb is placed on the control surface 72 with the middle finger under the control surface 70. The rear portion of the control surface 74 is also placed over the top of the hand between the thumb and the index finger of the left hand.

The design of the contoured brush handle portion 30 provides a "three-point" grasp for better control of the brush 10. Not only is the control enhanced, but fatigue is reduced as well. The shape of the distal end 34 of the brush handle portion 30 is weighted to counterbalance the brush end 22 of the brush 10. This further minimizes fatigue in the use of the paint brush.

Figure 4:
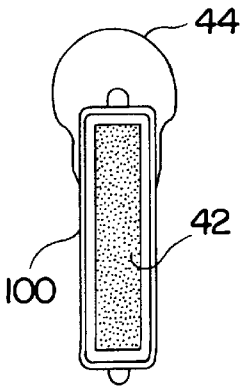
FIG. 4 is a cutaway view along lines 4—4 of FIG. 2.

A drip lip 100 is formed on the front surface 42 of front portion 36. The drip lip 100, in the preferred embodiment, extends outwardly from the bristles 20, as shown in FIG. 4. Other preferred embodiments of the drip lip 100 include a flared portion or an inverted portion.

The drip lip 100 on the front surface 42 of the integral front portion of the paint brush handle portion 30 provides protection from paint running or dripping onto the paint brush handle. The drip lip 100 prevents paint from creating problems not only on the paint brush handle, but also from dripping onto the user or surrounding surfaces, particularly when the paint brush is angled upward in use.

The bristles 20 include, in the preferred embodiment, a drip line 110, as shown in FIG. 1. Drip line 110 is formed, painted or otherwise marked at about the middle of the bristles 20.

The drip line 110 on the bristles 20 of the paintbrush 10 provides an indicator as to the appropriate depth of insertion of the paintbrush into the paint. This minimizes "over dipping" of the paint brush to avoid paint dripping or flowing onto the paintbrush handle. The dip line indicates the appropriate level for dipping the paintbrush into the paint for effective painting without creating a mess or wasting paint.

In another preferred embodiment of the present invention, the brush handle is adapted to be "retro-fitted" over an existing brush or portion of a brush. This provides an implement which can be easily fitted over prior brushes to provide the benefits of the present invention to those brushes.

These features, both singularly and in combination with one another, provide an ergonomic brush handle that has particular utility with paint brushes. The ease and comfort of use of the brush handle enables the user to more easily control the brush as well as reduce fatigue in manipulating the brush. The use of this brush handle is also more efficient from the standpoint of reducing the fatigue and in minimizing dripping and splattering of paint off of the bristles.

Figure 5:
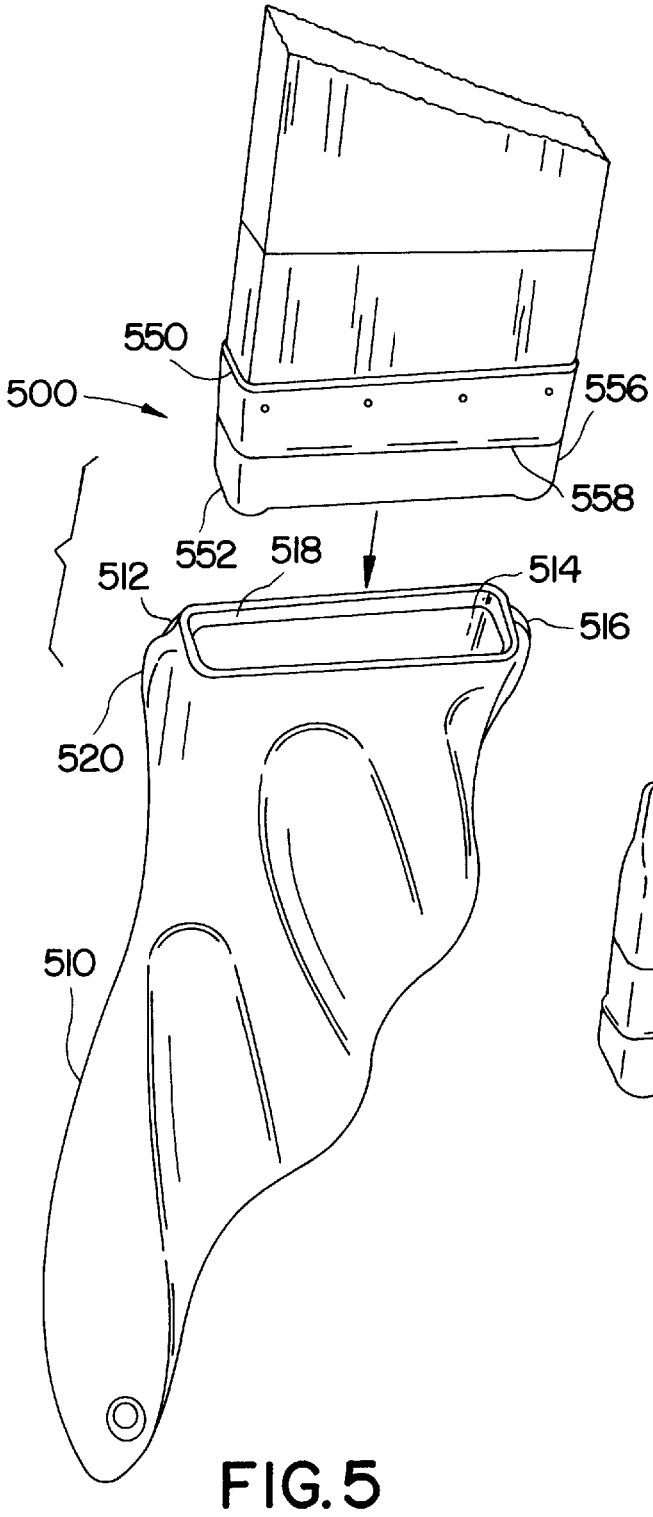
FIG. 5 is a perspective disassembled view of an alternative embodiment of the present invention illustrating a brush assembly.
Figure 6:
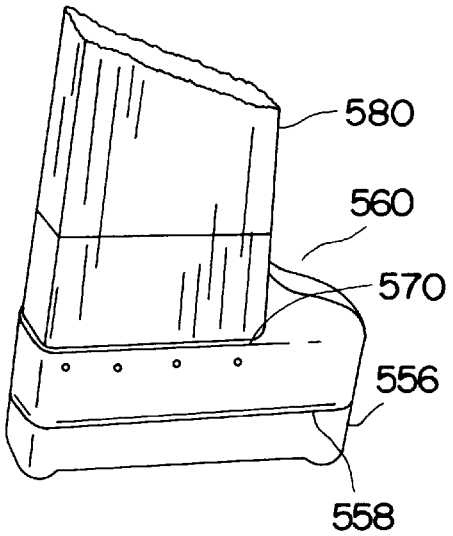
FIG. 6 is a perspective view of another brush head for use with the embodiment of FIG. 5.
Figure 7:
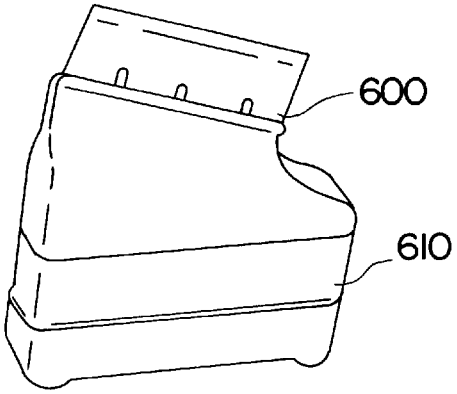
FIG. 7 is a perspective view of a scraper head for use with the embodiment of FIG. 5.

In yet another preferred embodiment of the present invention, as shown in FIGS. 5–7, the brush assembly 500 includes a brush handle 510 and a brush head 550. The brush handle 510 is similar to the brush handle 30 described above with the exception of the proximal end of the brush handle. The proximal end 512 of brush handle 510 includes a socket 514. The socket 514 has a recess portion 516 which terminates in an inner edge 518. The proximal end 512 also includes front surface 520.

The distal end 552 on the brush head 550 includes an engaging member 556. This engaging member is dimensioned to be received within the recess portion 516 of the socket 514 of the brush handle 510. A rib 558 is formed around the mid section of the brush head 550 to provide a detent surface which engages against the front surface 520 of the brush handle 510. This prevents the brush head from slipping further into the socket of the brush head.

In this preferred embodiment, the brush head 550 includes an angled brush 560, similar to the brush described above. It is to be expressly understood that other brushes could be used with such a brush head, for instance, a trim brush 580 shown on brush head 570 in FIG. 6.

Another important feature with the present invention is the use of accessories on an interchangeable brush head, such as the scraper 600 on brush head 610 shown in FIG. 7. Other brushes, tools and/or accessories could be used as well in the present invention.

Other embodiments of this alternative embodiment are possible as well. For instance, the brush heads could be inserted from the side instead of the front of the brush handle. A side slot-type connection could be used, or a dovetail type connection as well.

It is to be expressly understood that while preferred forms of the invention are herein set forth and disclosed, that the above and other modifications and changes may be made therein without departing from the spirit and scope of the present invention as defined by the appended claims.

We claim:

1. A brush handle adapted to fit between a user's thumb and fingers, said handle having an elongated body with opposing sides parallel to a first plane; said body terminating at one end in an end face; said end face lying in a second plane perpendicular to said first plane; said end face having a recess; a gripping portion parallel with the first plane and angled upwardly and rearwardly from the recess to an opposite end of said body, said gripping portion including at least two elongated indentations extending lengthwise on at least one of said opposing sides in a direction substantially parallel to said first plane, each said indentation having a closed end adjacent to said recess.

2. The brush handle of claim 1 wherein said control surface means include:

at least one concave indentation for engagement by a user's finger.

3. The brush handle of claim 1 wherein said indentations include:

a plurality of concave indentations along opposing surfaces of said gripping portion;

at least one of said indentations for engagement by a user's finger on a first of said side opposing surfaces; and at least one of said indentations for engagement by a user's thumb on a second of said side opposing surfaces.

4. The brush handle of claim 1 wherein said brush handle includes:

an upper surface; and at least one indentation formed on said upper surface for engagement by a finger of the user.

5. The brush handle of claim 3 wherein said brush handle includes:

an upper surface;

at least one indentation formed on said upper surface for engagement by a finger of a user;

a lower surface;

at least one indentation formed on said lower surface for engagement by a finger of a user;

said upper and lower surfaces converging rearwardly toward one another;

a first of said indentations formed on a first of said opposing side surfaces for engagement by a finger of the user; and a second of said indentations formed on a second of said opposing side surfaces for engagement by a thumb of the user.

6. The brush handle of claim 3 wherein said brush handle includes:

selected of said indentations for engagement by the fingers of a right handed user; and selected of said indentations for engagement by the fingers of a left handed user.

7. The brush handle of claim 1 wherein:

said indentations are staggered lengthwise along said opposing side surfaces.

8. The brush handle of claim 7 wherein:

a lower surface is disposed on said brush handle adjacent said opposite end; and an indentation is formed on said lower surface adjacent said opposite end for engagement with a portion of the hand between the thumb and finger of a user, and said indentations are in the form of elongated tear drops.

9. The brush handle of claim 1 wherein said brush handle includes:

means formed integrally on said brush handle for affixing brush application media onto said end face of said brush handle.

10. The brush handle of claim 1 wherein said brush handle further includes:

protective means for preventing paint from dripping onto said brush handle.

11. The brush handle of claim 1 wherein said brush handle further includes:

a lip formed on said proximal end of said brush handle to prevent paint from dripping onto said brush handle.

12. The brush handle of claim 1 wherein said brush handle further includes:

application media affixed onto said brush handle; and a drip line on a mid portion of said application media to indicate the appropriate level to dip said application media in paint to minimize dripping of paint from said application media.

13. The brush handle of claim 1 wherein said brush handle further includes:

a brush head having an engaging member wherein said brush head is releasably engageable in said recess, forwardmost of said indentations.

14. The brush handle of claim 13 wherein said brush handle includes:

a plurality of said brush heads, wherein each of said brush heads includes said engaging member for interchangeably, releasably engaging in said recess and each of said brush heads include one of brushes, tools and accessories.

15. A brush adapted to fit between a user's thumb and fingers, said brush including a handle having an elongated body with opposing sides parallel to a first plane; said body terminating at one end in an end face; said end face lying in a second plane perpendicular to said first plane; said end face having a bristle receiving recess; said recess further having bristles extending therefrom in a direction parallel to the first plane; a gripping portion parallel with the first plane and angled upwardly and rearwardly from the recess to an opposite end of said body, said gripping portion including at least two elongated indentations extending lengthwise on at least one of said opposing sides in a direction substantially parallel to said first plane, each said indentation having a closed end adjacent to said recess; said brush further including a dip line extending across said bristles at a location appropriate to indicate the depth that the bristles should be dipped into a paint source.

16. The brush of claim 15 wherein said brush handle further comprises:

an upper surface having at least one indentation for engagement by a user's fingers near said end face of said brush handle; and a lower surface having at least one concave indentation for engagement by a user's hand to provide support and control to said brush handle.

17. The brush of claim 15 wherein said brush handle further comprises:

a protective rail formed on said end face of said brush handle to protect said brush handle from paint dripping onto said brush handle.

18. The brush of claim 15 wherein said brush handle further includes:

a brush head having an engaging member for releasably engaging in said recess on said brush handle.

19. The brush of claim 18 wherein said brush further includes:

a plurality of brush heads wherein each of said brush heads includes brushes, tools and accessories; and an engaging member on each of said brush heads for releasably engaging in said recess on said brush handle.

20. A tool kit having a handle and a plurality of interchangeable components, said kit comprising a handle adapted to fit between a user's thumb and fingers, said brush including a handle having an elongated body with opposing sides parallel to a first plane; said body terminating at one end in an end face; said end face lying in a second plane perpendicular to said first plane; said end face having a bristle receiving recess; said recess further having one of brushes, tools, and accessories interchangeably mounted in said recess and extending therefrom in a direction parallel to the first plane; a gripping portion parallel with the first plane and angled upwardly and rearwardly from the recess to an opposite end of said body, said gripping portion including at least two elongated indentations extending lengthwise on at least one of said opposing sides in a direction substantially parallel to said first plane, each said indentation having a closed end adjacent to said recess.

21. The brush handle of claim 20 wherein said brush handle further comprises:

opposing side surfaces formed on said brush handle;

a gripping portion extending rearwardly from said end face of said brush handle;

a first set of indentations formed on said opposing side surfaces as part of said gripping portion for engagement by the fingers of a user; and a handle portion on said gripping portion near said opposite end for engagement by the hand of a user.

22. The brush handle of claim 20 wherein said brush handle further comprises:

an upper surface and a lower surface formed on said brush handle;

indentations formed on said upper surface for engagement by a user's fingers near said proximal end of said brush handle; and indentations formed on said lower surface for engagement by a user's hand to provide support and control to said brush handle.

23. The brush handle of claim 20 wherein said brush handle further comprises:

application media affixed on said end face of said brush handle; and a dip line extending across said application media at a location appropriate to indicate the necessary depth that said application media should be dipped into the paint source.

24. A brush adapted to fit between a user's thumb and fingers, said brush including a handle having an elongated body with opposing sides parallel to a first plane; said body terminating at one end in an end face; said end face lying in a second plane perpendicular to said first plane; said end face having a bristle receiving recess; said recess further having bristles extending therefrom in a direction parallel to the first plane; a gripping portion parallel with the first plane and angled upwardly and rearwardly from the recess to an opposite end of said body, said gripping portion including at least two elongated indentations extending lengthwise on at least one of said opposing sides in a direction substantially parallel to said first plane, each said indentation having a closed end adjacent to said recess.

25. The brush of claim 24 wherein said brush further includes:

said indentations are staggered rearwardly along opposite sides of said gripping portion in closely spaced, parallel relation to one another.

26. The brush of claim 24, wherein said brush further includes:

an upper surface on said gripping portion angled upwardly and rearwardly from said front portion; and a lower surface extending upwardly and rearwardly from said front portion with a series of stepped surface portions.

27. The brush of claim 26 wherein said stepped portions converge rearwardly toward said upper surface.

28. The brush of claim 24 wherein said indentations are formed symmetrically on opposites sides of said gripping portion.

29. The brush of claim 24 wherein said brush further includes:

a front rail extending outwardly from said front portion to minimize dripping from said bristle portion.

30. The brush of claim 24 wherein said brush further includes:

a dip line extending across said bristle portion at a location appropriate to indicate the necessary depth that said bristle portion should be dipped into a liquid source to minimize dripping.

31. The brush of claim 24 wherein said bristle portion further includes:

a plurality of brush heads wherein each of said brush heads includes one of brushes, tools and accessories; and an engaging member on each of said brush heads releasably engageable in said recess.

* * * * *